US008142725B2

(12) United States Patent
Hommeltoft et al.

(10) Patent No.: US 8,142,725 B2
(45) Date of Patent: Mar. 27, 2012

(54) APPARATUS FOR PRODUCING ALKYLATE GASOLINE AND MIDDLE DISTILLATE

(75) Inventors: Sven Ivar Hommeltoft, Pleasant Hill, CA (US); Howard S. Lacheen, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/178,729

(22) Filed: Jul. 8, 2011

(65) Prior Publication Data

US 2011/0262308 A1 Oct. 27, 2011

Related U.S. Application Data

(62) Division of application No. 12/233,481, filed on Sep. 18, 2008, now Pat. No. 8,070,939.

(51) Int. Cl.
*G05B 99/00* (2006.01)

(52) U.S. Cl. ..... 422/105; 208/133; 585/709; 585/712; 585/727; 585/729; 585/741; 585/742; 585/743; 585/744; 585/745; 585/746; 585/747; 422/106; 422/107

(58) Field of Classification Search ..... 208/133; 585/709, 712, 721, 727–729, 741–747; 422/105–107
See application file for complete search history.

(56) References Cited

U.S. PATENT DOCUMENTS

| | | | |
|---|---|---|---|
| 2,983,774 | A | 5/1961 | Thompson |
| 4,031,912 | A | 6/1977 | Lu et al. |
| 6,403,743 | B1 | 6/2002 | Clark et al. |
| 6,507,020 | B2 | 1/2003 | Shiokawa et al. |
| 7,569,740 | B2 | 8/2009 | Elomari |
| 7,919,663 | B2 | 4/2011 | Hommeltoft et al. |
| 7,919,664 | B2 | 4/2011 | Hommeltoft et al. |
| 7,923,593 | B2 | 4/2011 | Hommeltoft et al. |
| 7,955,495 | B2 | 6/2011 | Hommeltoft et al. |
| 2007/0225538 | A1 | 9/2007 | Elomari |

OTHER PUBLICATIONS

Dennis Jaumain and Bao-Lian Su, "Monitoring Bronsted Acidity of Zeolies by Means of In-Situ FT-IR and Catalytic Testing Using Chloromethane as Probe Molecule", Catalysis Today, Apr. 2002, pp. 187-196, vol. 73.

*Primary Examiner* — Robert J Hill, Jr.
*Assistant Examiner* — Brian McCaig
(74) *Attorney, Agent, or Firm* — Susan M. Abernathy

(57) ABSTRACT

An apparatus comprising: a) an alkylation reactor holding an ionic liquid catalyst and a reactant mixture, b) a means for measuring levels of a halide in an effluent from the alkylation reactor, and c) a control system that receives a signal in response to the measuring and communicates changes in an operating condition that influences the yield of products from the reactant mixture. The control system is responsive to deviations outside a predetermined range of halide level that has been selected to obtain a ratio of a yield of an alkylate gasoline and a yield of a middle distillate from 0.31 to 4.0 in the product from the alkylation reactor.

16 Claims, 3 Drawing Sheets

Effect of HCl Levels Measured in Effluent

Continuous Reactor Process

APPARATUS FOR PRODUCING ALKYLATE GASOLINE AND MIDDLE DISTILLATE

This application is a division of prior application Ser. No. 12/233,481, now U.S. Pat. No. 8,070,939, filed Sep. 18, 2008, and published as US 2010-0065476 A1, herein incorporated in its entirety. The assigned art unit of the prior parent application is 1774.

FIELD OF THE INVENTION

This application is directed to an apparatus comprising a reactor holding an ionic liquid, a means for measuring a halide in an effluent from the reactor, and a control system that is responsive to the halide level.

DETAILED DESCRIPTION OF THE INVENTION

Figure 1:
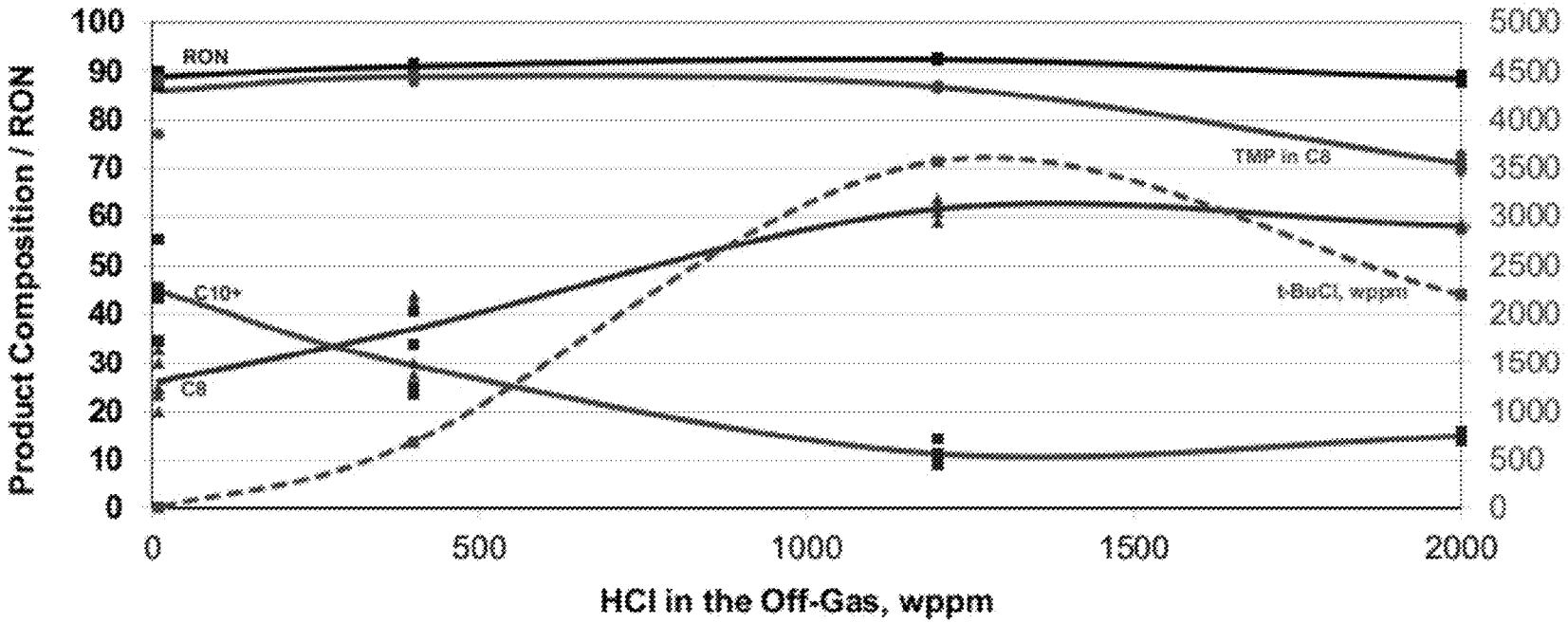
FIG. 1 illustrates the effect of HCl levels measured in the effluent on the product composition and RON of the alkylate produced in a continuous ionic liquid alkylation process.

Definitions:

The term "comprising" means including the elements or steps that are identified following that term, but any such elements or steps are not exhaustive, and an embodiment can include other elements or steps.

A "middle distillate" is a hydrocarbon product having a boiling range between 250° F. to 1100° F. (121° C. to 593° C.). The term "middle distillate" includes the diesel, heating oil, jet fuel, and kerosene boiling range fractions. It can also include a portion of naphtha.

A "naphtha" is a mix of C5-C9 with a boiling range of 140° F. to 212° F. (60° C. to 100° C.). It is an intermediate that can be further processed to make gasoline.

A "gasoline" is a liquid motor fuel having C5-C12, and a boiling range between 104° F. to 401° F. (40° C. to 205° C.).

A "kerosene" is a liquid fuel for jet engines and tractors and a starting material for making other products. It has C10-C18, and a boiling range of 350° F. to 617° F. (175° C. to 325° C.).

A "jet fuel" is a hydrocarbon product having a boiling range in the jet fuel boiling range. The term "jet fuel boiling range" refers to hydrocarbons having a boiling range between 280° F. and 572° F. (138° C. to 300° C.).

A "diesel distillate" is a liquid hydrocarbon used for diesel fuel and heating oil and can be a starting material for making other products. It has C12+. Diesel distillate has a boiling range of (250° C. to 350° C.).

A "lubricating oil" is a liquid hydrocarbon with longer carbon chains of C20 to C70. It is used to blend finished lubricants, such as motor oil, grease, metalworking fluids, and industrial oils. Lubricating oil has a boiling range of 572° F. to 1200° F. (300° C. to 649° C.).

A "fuel oil" is long chain hydrocarbon used for industrial fuel and as a starting material for making other products. It has a boiling range of 700° F. to 1112° F. (370° C. to 600° C.).

The "boiling range" is the 10 vol % boiling point to the final boiling point (99.5 vol %), inclusive of the end points, as measured by ASTM D 2887-06a and ASTM D 6352-04.

An "alkylate gasoline" is composed of a mixture of high-octane, branched-chain paraffinic hydrocarbons, such as iso-pentane, iso-hexane, iso-heptane, and iso-octane. Alkylate gasoline is a premium gasoline blending stock because it has exceptional antiknock properties and is clean burning.

A "Bronsted acid" is a compound that donates a hydrogen ion (H+) to another compound. "Bronsted acidity" is the Bronsted acid strength of a compound or catalyst.

Test Method Descriptions:

The Research-Method Octane Number (RON) is determined using ASTM D 2699-07a.

The wt % of the different hydrocarbons is determined by high resolution gas chromatography (GC), such as by ASTM D 6733-01(R-2006).

Bronsted acidity can be measured, for example, by the selectivity of products of chloromethane conversion by means of in situ FT-IR spectroscopy using chloromethane as the probe molecule. This test method is described in Denis Jaumain and Bao-Lian Su, "Monitoring the Bronsted acidity of zeolites by means of in-situ FT-IR and catalytic testing using chloromethane as probe molecule", Catalysis Today, Volume 73, Issues 1-2, April 2002, Pages 187-196.

Processes:

We have invented a process, comprising: a) taking a sample from a continuous reactor process; b) measuring a content of a halide in the sample; and c) in response to the measured content of the halide, adjusting a flow of a halide-containing-additive comprising the halide into the continuous reactor process in order to control an operating condition in the continuous reactor process; wherein the continuous reactor process is selected from the group consisting of olefin alkylation, olefin oligomerization, aromatics alkylation, hydrocracking, dehalogenation, dehydration, and combinations thereof.

We have also invented a process, comprising: a) taking a sample from a continuous reactor process; b) measuring a content of a halide in the sample taken from the continuous reactor process; and c) within 45 minutes from the taking a sample, adjusting a flow of a halide-containing-additive comprising the halide into the continuous reactor process to control a ratio of a yield of an alkylate gasoline and a yield of a middle distillate in a total product from the continuous reactor process.

We have also invented a process, comprising: a) taking a sample from an effluent of a reactor in a continuous reactor process; b) measuring a content of a halide in the sample; and c) in response to the measured content of the halide, adjusting a flow of a halide-containing-additive into an ionic liquid catalyst that is fed into the reactor.

In some embodiments the process is performed by repeating the taking, measuring, and adjusting steps more than once. In other embodiments the taking, measuring, and adjusting steps can be done continuously over a period of time, such as over several minutes, several days, or several months up to several years. The repeated steps can be done to maintain a level of the halide that is effective for a conversion. The conversion can be the conversion of an olefin to an alkylate, the conversion of a olefin to an oligomer, the conversion of an aromatic to an alkylate, the conversion of a longer hydrocarbon into a shorter hydrocarbon, the conversion of a halogenated hydrocarbon to a hydrocarbon without or having less halogen, the conversion of a hydrated hydrocarbon to a dehydrated hydrocarbon, or combinations thereof. Alternatively the steps can be repeated to optimize the selectivity of products produced in the reactor or increase a yield of a product.

The continuous reactor process is one that operates over a period of time without shutdown, such as for example for greater than four hours, greater than a day, for more than a month, or for several months up to several years. The continuous reactor process can be any number of different processes, including olefin alkylation, olefin oligomerization, aromatics alkylation, hydrocracking, dehalogenation, dehydration, hydroisomerization, hydroisomerization dewaxing, and combinations thereof.

The sample could be the entire reactor effluent stream or it could be a withdrawn fraction of the reactor effluent. In one embodiment the sample is a separated off-gas fraction from the reactor effluent. The taking of a sample can be performed from an effluent from a reactor in the continuous reactor process.

Alternatively, the sample could be a feed stream or fraction of a feed stream to the continuous reactor process. The taking of a sample could be performed from a feed stream to the continuous reactor process.

In another embodiment, the taking a sample is performed from an ionic liquid catalyst phase in a reactor that is part of the continuous reactor process.

In one embodiment the halide is selected from the group of a metal halide, a hydrogen halide, an alkyl halide, and mixtures thereof. In one embodiment the halide is a chloride, for example hydrogen chloride (HCl).

In one embodiment the process comprises adjusting a flow of a halide-containing-additive comprising the halide that is measured into the continuous reactor process in order to control an operating condition in the continuous reactor process. Examples of operating conditions that can be controlled include the Bronsted acidity of a catalyst, the catalyst flow into the reactor, the flow of the halide-containing-additive into the reactor, the reactor temperature, the reactant mixture, the agitation rate in the reactor, the residence time of reactants in the reactor, or mixtures thereof.

In some embodiments the step of adjusting a flow occurs within a short period of time of the step of taking a sample, in order to give real-time control to the continuous reactor process. Examples of short periods of time are within 1 hour, within 45 minutes, within 30 minutes, within 15 minutes, or within 5 minutes. The choice of the test method for measuring the halide will influence how short this time period can be. The halide can be measured by a test method selected from the group consisting of infrared absorption in a gas phase, pH measurement of extracted halide in water, electrical conductivity, mass spectrometry, halide selective electrodes, coulometric titration, gas chromatography, infrared spectroscopy of an ionic liquid phase, NMR on an ionic liquid phase, and combinations thereof.

In one embodiment the continuous reactor process uses an ionic liquid catalyst.

Ionic Liquid Catalyst

The ionic liquid catalyst is composed of at least two components which form a complex. To be effective at alkylation the ionic liquid catalyst is acidic. The ionic liquid catalyst comprises a first component and a second component. The first component of the catalyst will typically comprise a Lewis Acidic compound selected from components such as Lewis Acidic compounds of Group 13 metals, including aluminum halides, alkyl aluminum halide, gallium halide, and alkyl gallium halide (see International Union of Pure and Applied Chemistry (IUPAC), version3, October 2005, for Group 13 metals of the periodic table). Other Lewis Acidic compounds besides those of Group 13 metals can also be used. In one embodiment the first component is aluminum halide or alkyl aluminum halide. For example, aluminum trichloride can be used as the first component for preparing the ionic liquid catalyst.

The second component making up the ionic liquid catalyst is an organic salt or mixture of salts. These salts can be characterized by the general formula Q+A−, wherein Q+ is an ammonium, phosphonium, boronium, iodonium, or sulfonium cation and A− is a negatively charged ion such as Cl—, Br—, $ClO_4^-$, $NO_3^-$, $BF_4^-$, $BCl_4^-$, $PF_6^-$, $SbF_6^-$, $AlCl_4^-$, $TaF_6^-$, $CuCl_2^-$, $FeCl_3^-$, $HSO_3^-$, $RSO_3^-$, $SO_3CF_3^-$, and 3-sulfurtrioxyphenyl. In one embodiment the second component is selected from those having quaternary ammonium halides containing one or more alkyl moieties having from about 1 to about 12 carbon atoms, such as, for example, trimethylamine hydrochloride, methyltributylammonium, or substituted heterocyclic ammonium compounds, such as hydrocarbyl substituted pyridinium compounds for example 1-butylpyridinium, benzylpyridinium, or hydrocarbyl substituted imidazolium halides, such as for example, 1-ethyl-3-methylimidazolium chloride. In one embodiment the ionic liquid catalyst is selected from the group consisting of hydrocarbyl substituted pyridinium chloroaluminate, hydrocarbyl substituted imidazolium chloroaluminate, and mixtures thereof. For example, the ionic liquid can be an acidic haloaluminate ionic liquid, such as an alkyl substituted pyridinium chloroaluminate or an alkyl substituted imidazolium chloroaluminate of the general formulas A and B, respectively.

A

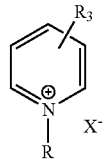

B

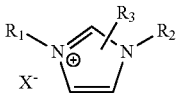

In the formulas A and B; R, $R_1$, $R_2$, and $R_3$ are H, methyl, ethyl, propyl, butyl, pentyl or hexyl group, X is a chloroaluminate. In the formulas A and B, R, $R_1$, $R_2$, and $R_3$ may or may not be the same.

In another embodiment the ionic liquid catalyst can have the general formula $RR'R''NH^+Al_2Cl_7^-$, and wherein RR' and R" are alkyl groups containing 1 to 12 carbons, and where RR' and R" may or may not be the same.

The presence of the first component should give the ionic liquid a Lewis or Franklin acidic character. Generally, the greater the mole ratio of the first component to the second component, the greater the acidity of the ionic liquid mixture.

Halide-Containing-Additive

The halide-containing-additive can be selected, and present at a level, to provide increased yield of selected products. In one embodiment, steps (a)-(c) are repeated to maintain a level of the halide that is effective for obtaining a yield of a product selected from the group of middle distillate, alkylate gasoline, naphtha, gasoline, kerosene, jet fuel, diesel distillate, lubricating oil, and fuel oil.

The halide-containing-additive can boost the overall acidity and change the selectivity of the ionic liquid-based catalyst. Examples of halide-containing-additives are hydrogen halide, alkyl halide, metal halide, and combinations thereof. In one embodiment, the halide-containing-additive can be a Bronsted acid. Examples of Bronsted acids are hydrochloric acid (HCl), hydrobromic acid (HBr), and trifluoromethanesulfonic acid. The use of halide-containing-additives with ionic liquid catalysts is disclosed in U.S. Published Patent Application Nos. 2003/0060359 and 2004/0077914. In one embodiment the halide-containing-additive is a fluorinated alkane sulphonic acid (a Bronsted acid) having the general formula:

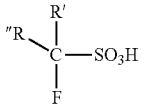

wherein R'=Cl, Br, I, H, an alkyl or perfluoro alkyl group, and R"=H, alkyl, aryl or a perfluoro alkoxy group.

Examples of metal halides that can be used are NaCl, LiCl, KCl, BeCl2, CaCl2, BaCl2, SrCl2, MgCl2, PbCl2, CuCl, ZrCl4 and AgCl, as described by Roebuck and Evering (Ind. Eng. Chem. Prod. Res. Develop., Vol. 9, 77, 1970). In one embodiment, the halide-containing-additive contains one or more IVB metal compounds, such as ZrCl4, ZrBr4, TiCl4, TiCl3, TiBr4, TiBr3, HfCl4, or HfBr4, as described by Hirschauer et al. in U.S. Pat. No. 6,028,024.

In one embodiment, the halide-containing-additive is present during the reacting step at a level that provides increased yield of the middle distillate. Adjusting the level of the halide-containing-additive level can change the selectivity of the alkylation reaction. For example, when the level of the halide-containing-additive, e.g., HCl, is adjusted lower, the selectivity of the alkylation reaction shifts towards producing heavier products. In one embodiment, the adjustment in the level of the halide-containing-additive to produce heavier products does not impair the concurrent production of low volatility gasoline blending component.

Figure 3:
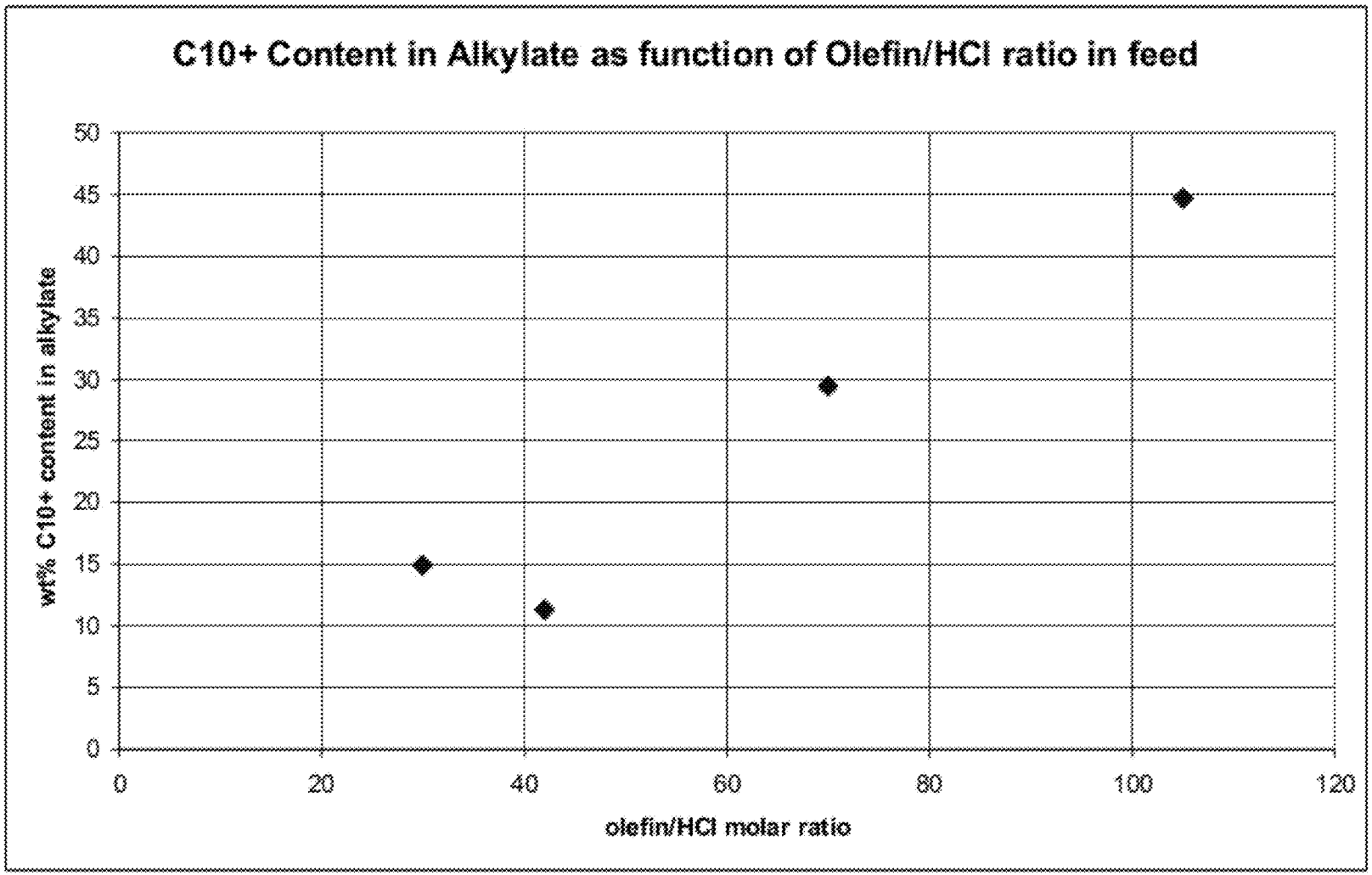
FIG. 3 illustrates the effects of increasing the molar ratio of olefin to HCl in the feed to an ionic liquid alkylation reactor on the yield of C10+ products in the alkylate produced.

The effects of increasing the molar ratio of olefin to HCl in the feed to an ionic liquid alkylation reactor (adjusting the level of the HCl lower) on the yield of C10+ products in the alkylate produced is demonstrated in FIG. 3.

In one embodiment the continuous reactor process is an alkylation process. The alkylation can occur in an alkylation reactor.

In one embodiment the content of the halide in the sample is in the range of 10 to 5,000 wppm. Other useful ranges can include 20 to 2,000 wppm, 50 to 10,000 wppm, 100 to 8,000 wppm, 10 to 800 wppm, 800 to 1,600 wppm, and 400 to 5,000 wppm.

The flow of the halide-containing-additive into the continuous reactor process can occur in varied or multiple locations. For example, the flow of the halide-containing-additive can be into a hydrocarbon feedstock, into an ionic liquid catalyst, or into a mixture thereof.

Alkylation Reactor

In embodiments comprising an alkylation reactor, the alkylation conditions in the reactor are selected to provide the desired product yields and quality. The alkylation reaction is generally carried out in a liquid hydrocarbon phase in a reactor. One example of a loop reactor is one where a stream comprised primarily of isoparaffin is recirculated to the ionic liquid alkylation reactor. Catalyst volume in the alkylation reactor is in the range of 1 vol % to 99 vol %, for example from 1 vol % to 80 vol %, from 2 vol % to 70 vol %, from 3 vol % to 50 vol %, or from 5 vol % to 25 vol %. In some embodiments, vigorous mixing can be used to provide good contact between the reactants and the catalyst. The alkylation reaction temperature can be in the range from −40° C. to 150° C., such as −20° C. to 100° C., or −15° C. to 50° C. The pressure can be in the range from atmospheric pressure to 8000 kPa. In one embodiment the pressure is kept sufficient to keep the reactants in the liquid phase. The residence time of reactants in the reactor can be in the range of a second to 360 hours. Specific examples of residence times that can be used include 0.1 min to 120 min, 0.5 min to 15 min, 1 min to 120 min, 1 min to 60 min, and 2 min to 30 min.

The molar ratio of isoparaffin to olefin during the alkylation can vary over a broad range. Generally the molar ratio is in the range of from 0.5:1 to 100:1. For example, in different embodiments the molar ratio of isoparaffin to olefin is from 0.5:1 to 25:1, 1:1 to 50:1, 1.1:1 to 10:1, or 1.1:1 to 20:1. Lower isoparaffin to olefin molar ratios will tend to produce a higher yield of middle distillate products.

The yield of middle distillate, for example, can be varied by changing the alkylation reactor operating conditions. Higher yields can be produced, for example, with lower amounts of the halide-containing-additive or with a lower isoparaffin to olefin molar ratio. In some embodiments, higher yields of middle distillate can be produced, for example, by using gentle agitation rather than vigorous mixing. In other embodiments, higher yields of middle distillates can be produced by using a shorter residence time of the reactants in the reactor, such as 0.5 min to 15 min.

Reactant Mixture

In one embodiment, the reactant mixture in the continuous reactor process comprises an olefin and an isoparaffin. The reactant mixture is fed to the alkylation reactor. In one example, the olefin comprises C2 olefin, C3 olefin, C4 olefins, C5 olefins, C6 olefins, C7 olefins, C6-C10 naphthenes or mixtures thereof. In another example, the reactant mixture comprises C4 isoparaffin, C5 isoparaffin, C6 isoparaffin, C7 isoparaffin, C8 isoparaffin, C6 naphthene, C7 naphthene, C8 naphthene, C10 naphthene, or mixtures thereof.

An Alkylate Gasoline and a Middle Distillate

In one embodiment the process controls a ratio of a yield of an alkylate gasoline and a yield of a middle distillate. The alkylate gasoline can comprise a C8 and the middle distillate can comprise a C10+. In some embodiments the C8 has greater than 80% or greater than 85% TMP and the total product has a RON greater than 90. Embodiments demonstrating this are shown in FIG. 1.

In another embodiment, the yield of C8 is greater than 25 wt % and the yield of C10+ is greater than 20 wt %. In a different embodiment, the yield of C8 is between 25 and 80 wt %, between 40 and 65 wt %, or between 45 and 80 wt %. In yet a different embodiment, the yield of C10+ is between 16 and 80 wt %, between 20 and 70 wt %, or between 0 and 18 wt %. One example of the process, shown in FIG. 1, has a yield of C8 greater than 45 wt % and the yield of C10+ is less than 20 wt %, when the level of HCL in the off-gas effluent was 800 wppm or higher.

In one embodiment the ratio of the yield of the alkylate gasoline to the yield of the middle distillate is from 0.31 to 4.0. In another embodiment the ratio of the yield of the alkylate gasoline to the yield of the middle distillate is from 2.25 to 160.

Apparatus:

We have also invented an apparatus, comprising: a) a reactor holding an ionic liquid catalyst and a reactant mixture; b) a means for measuring a first and subsequent level of a halide in an effluent from the reactor; and c) a control system that receives a signal in response to the first level and adjusts an operating condition that influences a subsequent level; wherein the control system is responsive to deviations outside a predetermined range of halide level that has been selected to obtain a yield of a product in the reactant mixture.

Examples of suitable reactors include stirred tank reactors, which can be either a batch reactor or a CSTR. Alternatively, a batch reactor, a semi-batch reactor, a riser reactor, a tubular reactor, a loop reactor, a continuous reactor, a static mixer, a packed bed contactor, or any other reactor and combinations of two or more thereof can be employed.

Figure 2:
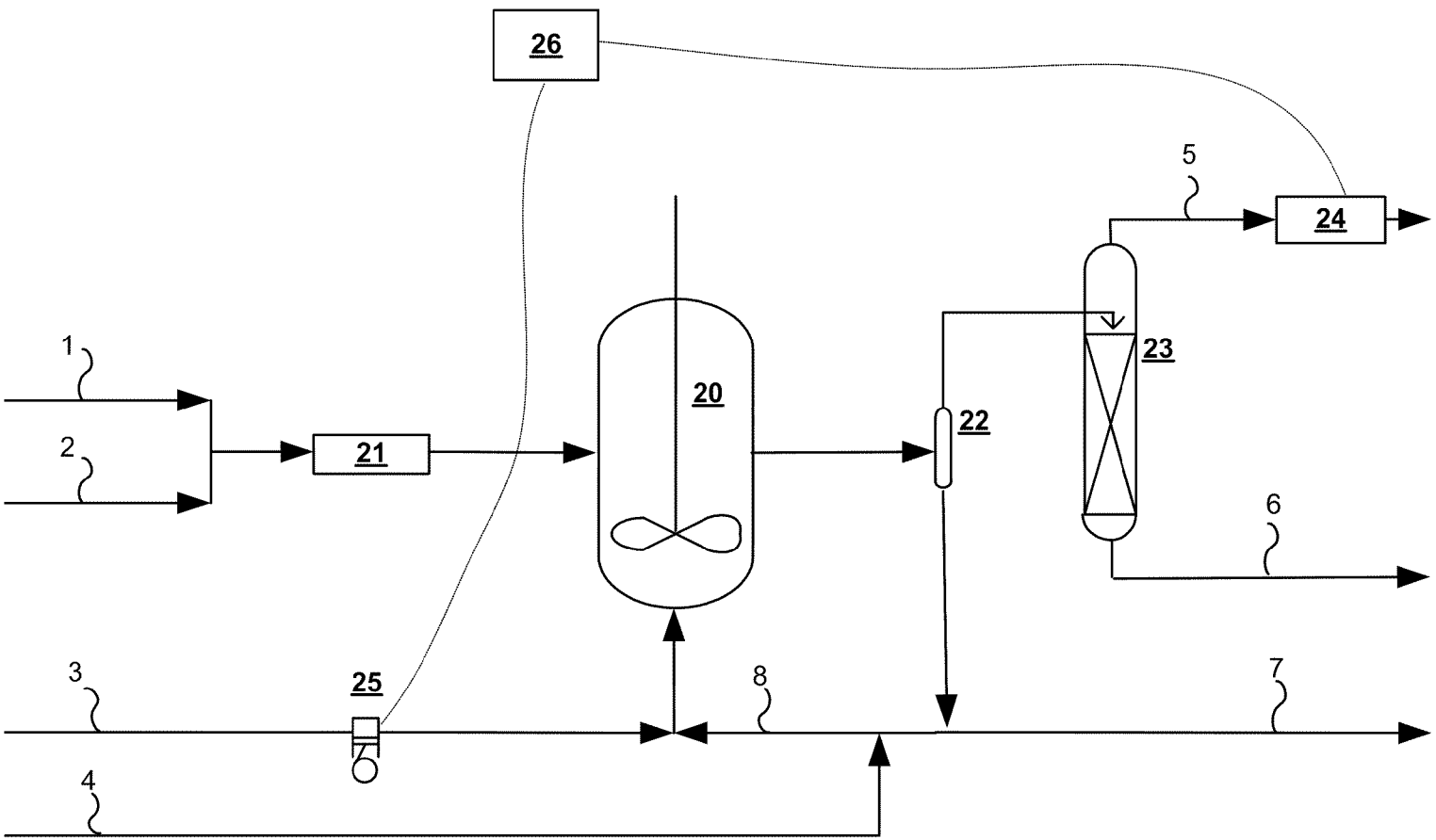
FIG. 2 is a diagram of one embodiment of the continuous reactor process.

The apparatus can be described by reference to one embodiment illustrated in FIG. 2. Referring to the drawing, olefin feed (1) and isoparaffin feed (2) are blended together and mixed in a mixer (21), then fed into a CSTR (20). HCl (3) is fed via a pump that adjusts the flow to be mixed with fresh ionic liquid catalyst (4) and recycled ionic liquid catalyst (8). The HCL/catalyst mixture is fed into the CSTR (20). The effluent from the reactor passes through a phase separator (22) to remove the used catalyst, some of which is recycled back to the reactor (8) and the remainder is withdrawn (7). The light products from the phase separator are fractionated in an atmospheric distillation column (23) to yield an effluent off-gas (5) and alkylate product (6). An on-line HCl analyzer (24) continuously measures the chloride content in the off-gas and sends a signal that is received by a control system (26) that is responsive to deviations outside a predetermined range of chloride that was selected to achieve a desired alkylate product distribution. The control system communicates changes to the operating conditions to maintain the chloride level in the predetermined range.

In one embodiment the product is a product selected from the group of middle distillate, alkylate gasoline, naphtha, gasoline, kerosene, jet fuel, diesel distillate, lubricating oil, and fuel oil. In another embodiment, the product is an alkylate gasoline, a middle distillate, or a combination thereof. The operating condition can be selected from any parameter that influences the subsequent level of halide in the effluent from the reactor. In one aspect the operating condition is one that obtains a yield of a product in the reactant mixture, increases the yield of a product, optimizes the selectivity of products in the reactor, or is effective for a conversion of a hydrocarbon in the reactor. In one embodiment, the operating condition is selected from the group consisting of a catalyst flow into the reactor, a flow of a halide-containing-additive (comprising the halide that is being measured) into the reactor, a reactor temperature, the reactant mixture, an agitation rate in the reactor, a residence time in the reactor, a Bronsted acidity of a catalyst in the reactor, a Lewis acidity of a catalyst in the reactor and combinations thereof.

In one embodiment, the reactor is an alkylation reactor, as described previously. Alternatively, the reactor is selected from the group of an alkylation reactor, an olefin oligomerization reactor, an aromatics alkylation reactor, a hydrocracking reactor, a dehalogenation reactor, a dehydration reactor, and combinations thereof.

In one embodiment, the reactant mixture comprises an olefin and an isoparaffin. The olefin can be any olefin, including C2-C12 olefin and C2-C7 olefin. The isoparaffin can be any isoparaffin, including C3-C12 isoparaffin and C4-C7 isoparaffin.

In some embodiments the molar ratio of isoparaffin to olefin is in a ratio that provides a desired selectivity of products, such as 0.5:1 to 200:1, or 0.5:1 to 25:1. In alkylation reactions the higher molar ratio will provide a better selectivity for gasoline alkylate product.

The control system can be physically a part of the apparatus, or separate; as long as it receives the signal and communicates changes in an operating condition. In one embodiment, the control system receives a signal in response to the subsequent level and communicates a further change in the operating condition. The step of: the control system receives the signal in response to the subsequent level and communicates the further change, can be repeated. In one embodiment the receiving and communicating is continuous.

In one embodiment, the full stream of off-gas is passed through the means for measuring the levels of the halide. In another embodiment, such as in a large industrial apparatus, the means for measuring the levels of the halide will be an analyzer, such as an infrared analyzer, placed on a small slip stream. The slip stream can be a small depressurized line, or a line that is heated to evaporate the contents within it.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art. Accordingly, the invention is to be construed as including all structure and methods that fall within the scope of the appended claims.

EXAMPLES

Example 1

An olefin feed was prepared from refinery butenes by selectively hydrogenating the mixture to remove dienes and to isomerize 1-butene to 2-butene. A pure isobutane feed was mixed with the olefin feed and fed into a 100 ml CSTR. The CSTR used N-butylpyridinium heptachlorodialuminate ionic liquid catalyst. Chloride was added to the reactor in the form of anhydrous HCl gas by adding it to the mixed feeds before they were fed into the reactor.

The HCl was soluble in the ionic liquid, but when the HCl activity was sufficiently high enough to catalyze isobutane alkylation, some of the HCl dissolved in the hydrocarbon phase.

The effluent from the reactor was separated by distillation into light hydrocarbon off-gas and alkylate product. An on-line HCl analyzer measured the HCl content in the off-gas over time. The alkylate products were collected at the same time as the HCl measurement. The alkylate products were analyzed by GC for wt % by carbon number of C8 and C10+, % TMP in the C8, and RON of the total alkylate. The results of the HCl measurements and the alkylate product compositions are shown in FIG. 1. The HCl content in the off-gas was a direct measure of the alkylation activity and product selectivity in the reactor. It was a convenient probe for the control of the chloride addition to the reactor.

Example 2

A mixed C3-C4 olefin feed was prepared from refinery butenes by spiking the butenes with propene and selectively hydrogenating the mixture to remove dienes and to isomerize 1-butene to 2-butene. A pure isobutane feed was mixed with the mixed C3-C4 olefin feed and fed into a 100 ml CSTR. The CSTR used N-butylpyridinium heptachlorodialuminate ionic liquid catalyst. Chloride was added to the reactor in the form of HCl. HCl was added to the ionic liquid catalyst just before it was introduced into the reactor.

The reactor conditions included a temperature of 10° C., a catalyst volume fraction of about 7 to 10%, an isoparaffin to olefin ratio in the reactor of from 0.07 to 0.10, and a propene content in the feed from 30 to 37 wt %. The HCl was soluble in the ionic liquid, but when the HCl activity was sufficiently high enough to catalyze isobutane alkylation, some of the HCl dissolved in the hydrocarbon phase.

The effluent from the reactor was separated by distillation into light hydrocarbon off-gas and alkylate product. An on-line HCl analyzer measured the HCl content in the off-gas over time. The analyzer measured the HCl in the gas phase by tunable laser infrared absorption spectroscopy. It was found that the level of the HCl fluctuated significantly less when the chloride was introduced with the catalyst than when the chloride was introduced in the mixed hydrocarbon feed to the reactor. In this example, the flow of the halide-containing-additive (comprising the halide) into the reactor additionally comprised the ionic liquid catalyst. The alkylate products were collected at the same time as the HCl measurements. The alkylate products were analyzed by GC for wt % by carbon number of C7+C8 and C10+, % TMP in the C8, and RON of the total alkylate.

The results of the HCl measurements and the alkylate product compositions are shown below in Table 1.

TABLE 1

| HCl in Off-Gas, wppm | 375 | 1100 |
|---|---|---|
| C7+ C8 | 56.4 | 69.7 |
| C10+ | 23.5 | 12.5 |
| RON | 87.0 | 90.2 |

Again, the HCl content in the off-gas was a direct measure of the alkylation activity and product selectivity in the reactor.

It is claimed:

1. An apparatus, comprising:

a. an alkylation reactor holding an ionic liquid catalyst and a reactant mixture;

b. a means for measuring a first and a subsequent level of a halide in an effluent from the alkylation reactor;

c. a control system that is configured to receive a signal in response to the first level and adapted to communicate changes in an operating condition that influences the subsequent level; wherein the control system is adapted to respond to deviations outside a predetermined range of halide level that has been selected to obtain a ratio of a yield of an alkylate gasoline to a yield of a middle distillate from 0.31 to 4.0 in a product from the alkylation reactor.

2. The apparatus of claim 1, wherein the control system is adapted to communicate changes in the operating condition selected from the group consisting of a catalyst flow into the reactor, a flow of a halide-containing-additive into the reactor, a reactor temperature, the reactant mixture, an agitation rate in the reactor, a residence time in the reactor, a Bronsted acidity of a catalyst in the reactor, a Lewis acidity of a catalyst in the reactor and combinations thereof.

3. The apparatus of claim 2, wherein the control system is adapted to communicate changes in the flow of the halide-containing-additive comprising the halide into the reactor.

4. The apparatus of claim 3, wherein the flow of the halide-containing-additive additionally comprises the ionic liquid catalyst.

5. The apparatus of claim 2, wherein the control system is adapted to communicate changes in the Bronsted acidity of a catalyst in the reactor.

6. The apparatus of claim 1, wherein the means for measuring is a test method selected from the group consisting of infrared absorption in a gas phase, pH measurement of extracted halide in water, electrical conductivity, mass spectrometry, halide selective electrodes, coulometric titration, gas chromatography, and combinations thereof.

7. The apparatus of claim 6, wherein the test method is infrared absorption in the gas phase.

8. The apparatus of claim 1, wherein the reactant mixture comprises a C2-C7 olefin and a C4-C7 isoparaffin.

9. The apparatus of claim 8, wherein a molar ratio of the isoparaffin to the olefin is from 0.5:1 to 25:1.

10. The apparatus of claim 1, wherein the reactor is selected from the group consisting of a batch reactor, a semi-batch reactor, a riser reactor, a tubular reactor, a loop reactor, a continuous reactor, a static mixer, a packed bed contactor, and combinations of two or more thereof.

11. The apparatus of claim 1, wherein the control system is adapted to receive a signal in response to the subsequent level and configured to communicate a further change in the operating condition.

12. The apparatus of claim 11, wherein the control system is adapted to repeat the step of: the control system receives the signal in response to the subsequent level and communicates the further change.

13. The apparatus of claim 1, wherein the apparatus is configured to yield a C8 fraction that is greater than 25 wt % and yield a C10+ fraction that is greater than 20 wt % in the product from the alkylation reactor.

14. The apparatus of claim 1, wherein the apparatus is configured to yield a C10+ fraction that is between 16 and 80 wt % in the product from the alkylation reactor.

15. The apparatus of claim 1, wherein the apparatus is configured to yield a C10+ fraction that is between 10 and 18 wt % in the product from the alkylation reactor.

16. The apparatus of claim 1, wherein the alkylation reactor is configured to operate continuously over several days up to several years.

* * * * *